United States Patent [19]

Henry

[11] 4,187,962

[45] Feb. 12, 1980

[54] FUEL SERVICE TANK WITH SELF-RETRACTING HOSE REEL

[75] Inventor: Elbert C. Henry, Concordia, Kans.

[73] Assignee: Henry Enterprises, Inc., Concordia, Kans.

[21] Appl. No.: 887,653

[22] Filed: Mar. 17, 1978

[51] Int. Cl.[2] ..... B67D 5/365

[52] U.S. Cl. ..... 222/173; 137/355.22; 188/82.7; 222/74; 222/526; 222/626; 242/107.7

[58] Field of Search ..... 222/74, 173, 626, 608, 222/526, 530, 538; 242/86.5 R, 107 R, 107.3, 107.6, 107.7; 191/12.2 R, 12.2 A; 239/195, 197, 199; 137/355.12, 355.16, 355.2, 355.21, 355.22, 355.23, 355.26; 188/82.7; 254/150 R, 159, 152, 156, 190 C

[56] References Cited

U.S. PATENT DOCUMENTS

| | | | |
|---|---|---|---|
| 2,551,469 | 5/1951 | Shea et al. | 242/107.3 |
| 2,563,714 | 8/1951 | Foster | 242/107.7 |
| 2,673,694 | 3/1954 | Howell | 242/107.3 |
| 2,825,767 | 3/1958 | Riedele | 191/12.2 R |
| 3,907,168 | 9/1975 | Davis et al. | 222/626 X |

*Primary Examiner*—Robert J. Spar
*Assistant Examiner*—Edward M. Wacyra
*Attorney, Agent, or Firm*—Schmidt, Johnson, Hovey & Williams

[57] ABSTRACT

A mobile liquid-dispensing apparatus usable for refueling airplanes and the like is provided which includes a reel-mounted, extensiblle and retractable, fluid delivery conduit connected to an adjacent liquid supply. Releasable one-way brake mechanism is also employed which allows extension of the conduit to a desired use position, but locks the conduit reel against spring-biased retractive rotation when the conduit has been extended. Selectively operable release structure associated with the brake allows spring-biased retraction of the conduit when the dispensing operation is completed. The conduit reel is preferably mounted for rotation about an upright axis and includes a guide for positive winding of the conduit in a helical manner about the reel during the retraction sequence.

8 Claims, 7 Drawing Figures

FUEL SERVICE TANK WITH SELF-RETRACTING HOSE REEL

BACKGROUND OF THE INVENTION

1. Field of the Invention

This invention is broadly concerned with liquid-dispensing devices which are particularly adapted to be mounted on a mobile vehicle for use in refueling airplanes or other equipment which cannot conveniently be brought to a central fuel depot. More particularly, the invention pertains to a mobile dispensing apparatus which includes a reel-mounted, spring-biased fluid delivery conduit allowing extension and retraction of the conduit as desired, along with brake and release mechanisms which facilitate the dispensing operation.

2. Description of the Prior Art

Refueling of small airplanes at rural outlying airports has long been a problem in view of equipment limitations at such airports. That is to say, it is generally not practical to provide expensive custom aircraft refueling equipment found in large municipal airports at small airport facilities. At the same time, mobile refueling equipment is very desirable, since it is sometimes difficult to maneuver aircraft to a central refueling station at an airport.

The farmer may also have a need for mobile refueling equipment. For example, it can be a costly and time consuming task to bring a piece of field equipment into a central refueling station far from the field. Moreover, simply transporting containers of fuel to such equipment and manually refueling the same generally is no solution. Just as in the case of small airports however, the farmer normally cannot afford to purchase and maintain expensive custom refueling equipment.

Therefore, there is a decided need for relatively simple and inexpensive liquid dispensing apparatus which can be used for refueling or other purposes, and which can be mounted as desired on a pickup truck bed or the like in order to render the equipment fully mobile.

SUMMARY OF THE INVENTION

The present invention is concerned with a simplified liquid-dispensing apparatus especially adapted for refueling of aircraft or other types of equipment, and which is particularly adapted to be mounted on a pickup truck bed or the like for purposes of mobility. Broadly, the apparatus includes a rotatable, biased reel having an extensible and retractable, flexible fluid delivery conduit wrapped thereabout. The conduit is connected to an adjacent tank having a quantity of a fuel or liquid therein, while the free end of the conduit is equipped with a dispensing head. The reel is preferably provided with a coil spring which undergoes a buildup of tension as the conduit is unwound from the reel, so as to bias the latter for retraction of the conduit after use thereof. Undesired retraction of the conduit is prevented through the use of releasable one-way brake mechanism which locks the conduit reel against retractive rotation when the conduit has been extended to a desired use position.

The release structure for the brake mechanism advantageously includes a pivotally mounted, spring biased flap which can be depressed manually or by pulling the conduit in a fashion to engage the flap. Pivoting of the flap in turn shifts the brake element from the rotation-blocking position thereof to free the reel and permit spring biased, rotative retraction of the conduit.

In particularly preferred forms, the liquid tank and delivery assembly are located within a common housing, and the reel is rotatable about an upright axis and has guide means thereon for facilitating positive helical winding of the conduit thereabout during rewinding operations.

DESCRIPTION OF THE PREFERRED EMBODIMENTS

Figure 1:
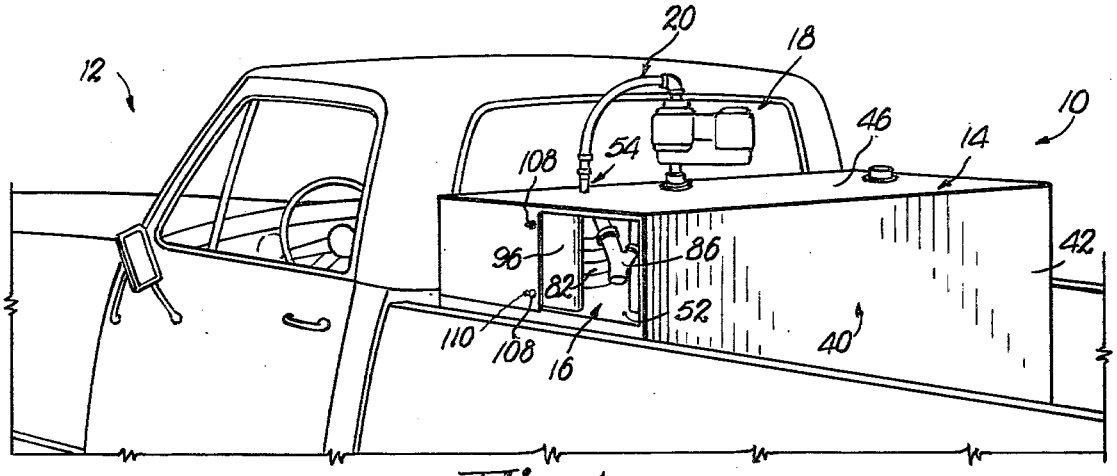
FIG. 1 is a perspective view of the liquid-dispensing apparatus of the present invention mounted on the bed of a pickup truck.

Turning now to the drawings, liquid-dispensing apparatus 10 in accordance with the invention is illustrated in FIG. 1 in an operative disposition mounted on the bed of a conventional pickup truck 12. Broadly, assembly 10 includes an enclosed tank 14 adapted to hold a liquid such as a fuel to be dispensed, a liquid-delivery assembly broadly referred to by the numeral 16, a selectively operable electric pump 18, and conduit means 20 which interconnects tank 14, pump 18, and liquid-delivery assembly 16. As will be explained in more detail hereinafter, liquid-dispensing apparatus 10 can be transported via truck 12 to any selected site, for dispensing of the liquid contained within tank 14.

Figure 4:
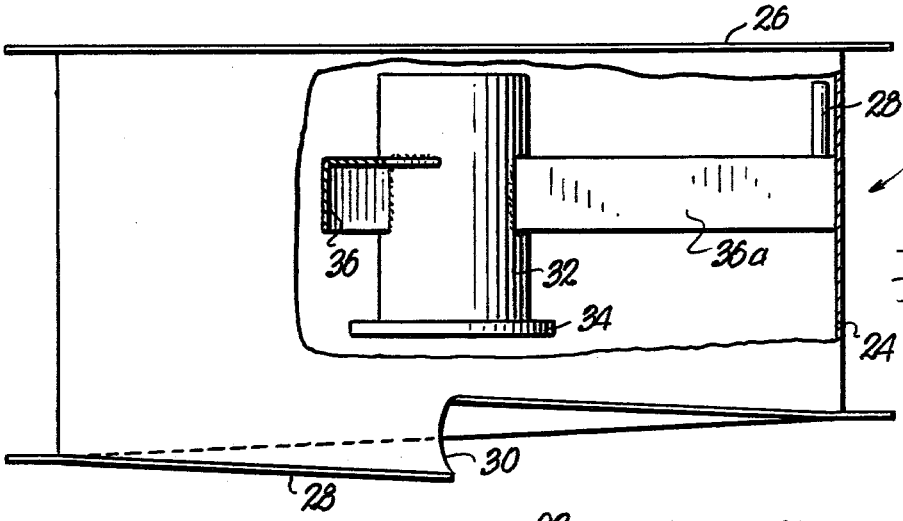
FIG. 4 is a side elevational view of the conduit reel forming a part of the liquid-delivery assembly, with parts broken away to illustrate the internal construction thereof.
Figure 5:
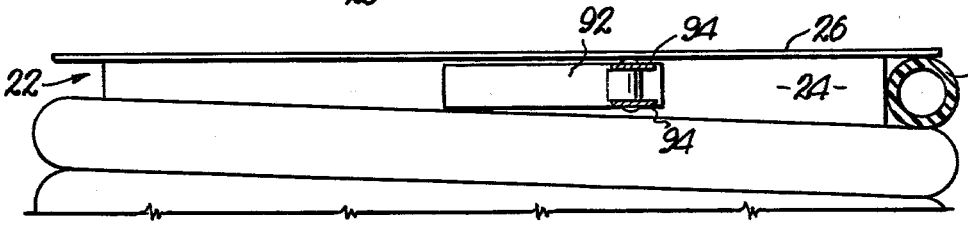
FIG. 5 is a fragmentary side elevational view taken along irregular line 5—5 of FIG. 2.
Figure 6:
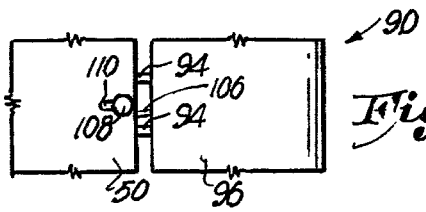
FIG. 6 is a fragmentary side elevational view illustrating the construction and mounting of the brake release flap.

Liquid-delivery assembly 16 includes a substantially tubular, upright, axially rotatable reel 22 having a tubular sidewall 24, a circular top wall 26 of greater diameter than that of the underlying sidewall, and a lowermost, substantially helical guide wall 28 which is likewise of larger diameter than the sidewall 24. A relatively short, arcuate edge 30 of sidewall 24 interconnects the vertically spaced, adjacent portions of guide wall 28 as best seen in FIG. 4. Internally, reel 22 includes tubular, upright, stationary, axially disposed bearing sleeve 32 having a lowermost radially extending connection lip 34. Three substantially radially extending supporting arms 36 are circumferentially spaced about sleeve 32 and extend therefrom and are connected to the internal surface of sidewall 24. One arm, labeled **36*a*, includes an upstanding connection post 38** which is important for reasons to be described.

Figure 3:
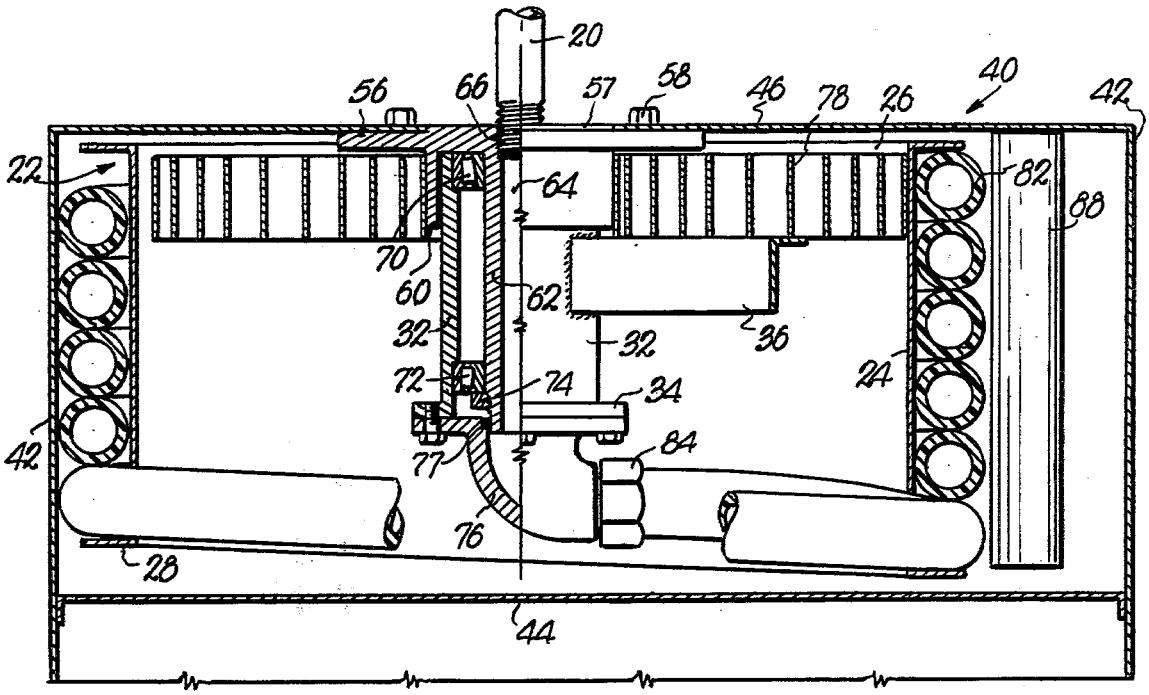
FIG. 3 is a fragmentary vertical sectional view of the liquid-delivery assembly of the invention.

As best seen in FIG. 3, reel 22 and all of the remaining structure making up the assembly 16 is mounted within a housing 40. Housing 40 includes spaced, planar sidewalls 42, a bottom wall 44, and an apertured top wall 46. A partition 48 serves to divide the housing 40. The right hand portion thereof as viewed in FIG. 1 is provided with an imperforate end wall (not shown) so as to define the enclosed liquid tank 14, whereas the remaining portion is provided with an end wall 50 which, in combination with the adjacent sidewall 42, defines a rectangular outlet opening 52. Thus, it will be seen that the tank 14 and delivery assembly 16 are disposed within a common housing 16 which can be mounted on a mobile vehicle or the like.

Referring specifically to FIG. 3, the mounting structure 54 for reel 22 will be explained. Structure 54 includes a plate 56 located within an aperture 57 of top wall 46 and fixedly secured to the latter by a series of screws 58. Plate 56 includes a depending, relatively short, outer circular wall 60, along with a longer, inwardly spaced, depending inner circular wall 62. The respective walls 60 and 62 cooperatively define an annular space therebetween for receiving sleeve 32 as will be described. Moreover, wall 62 defines an innermost, cylindrical, liquid-conveying passage 64 which extends along the length thereof. The uppermost internal surface of wall 60 is threaded as at 66 so as to threadably receive the lowermost threaded end of conduit means 20, thereby enabling a liquid to be pumped from the tank 14 through conduit means 20 and passage 64.

Reel 22 is mounted to plate 56 by passing the sleeve 32 upwardly into the annular space between the respective walls 60 and 62. In this regard, the internal surface of the sleeve 32 is provided with two sets of circumferentially disposed, tapered bearings 70 and 72, which are respectively located adjacent the top and bottom of the sleeve. These bearings 70 and 72 contact the outer surface of wall 62 and thus permit easy rotation of the reel 22 with respect thereto. A positive connection of the sleeve 32 in its operative disposition is assured by virtue of a retainer ring 74 secured adjacent the underside of the bearing set 72 as illustrated in FIG. 3. A rotatable, liquid-conveying elbow 76 is fixedly secured to lip 34 of sleeve 32 so that the elbow rotates in unison with the sleeve 32 and reel 22, and an O-ring seal 77 between the lower, outer periphery of wall 62 and the adjacent inner periphery of elbow 76 protectively seals off the annular space within which bearings 70 and 72 are located.

Figure 2:
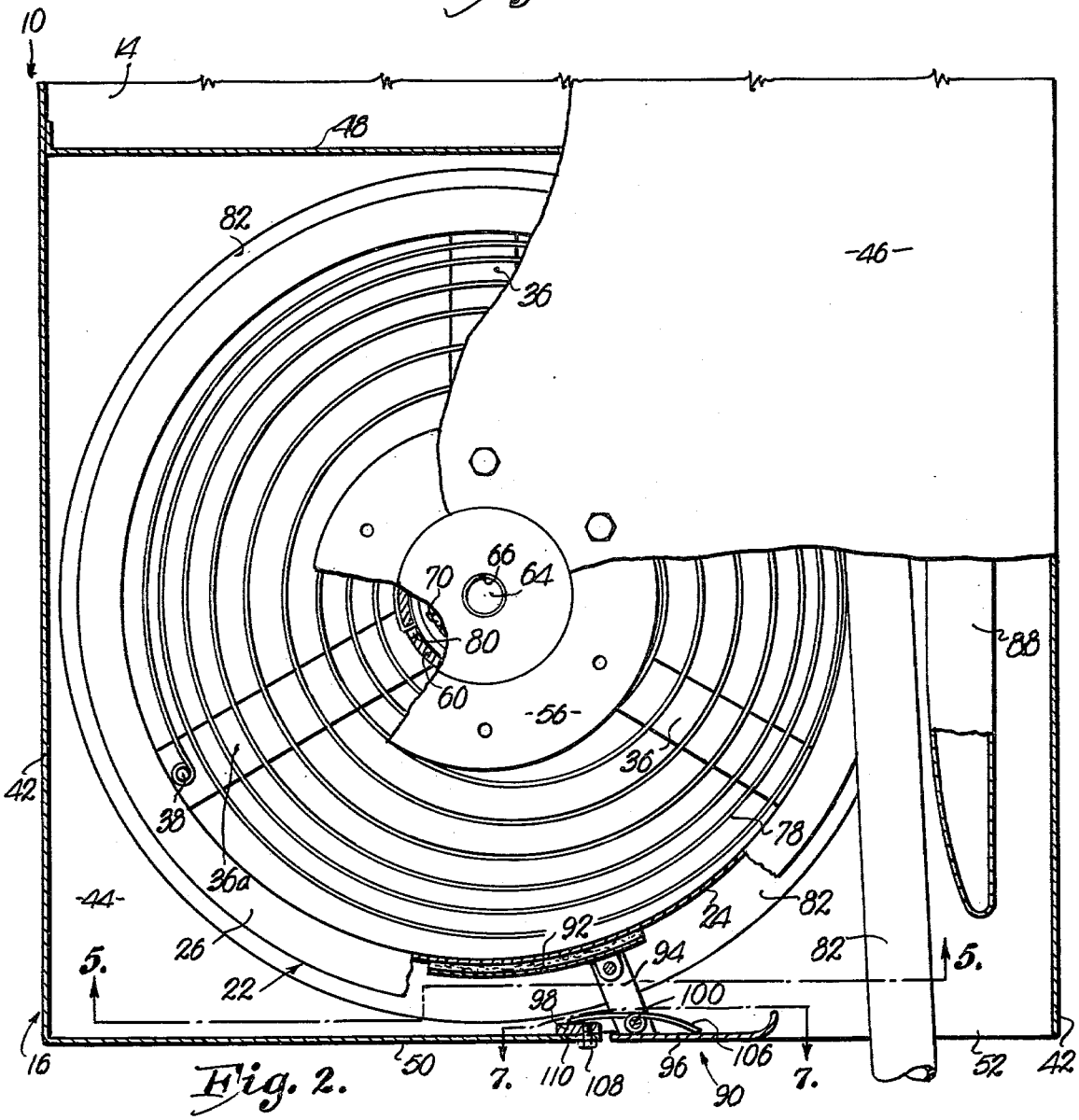
FIG. 2 is a fragmentary plan view of the liquid-dispensing apparatus, with parts broken away to illustrate the internal construction of the liquid-delivery assembly thereof.

A strap-type coil spring 78 is located between the arms 36 and the top wall 26 of reel 22. Referring particularly to FIG. 2, it will be seen that the inner end of spring 78 is fixedly located within a slot 80 provided in depending wall 60 of plate 56, whereas the outer end of the spring is wrapped about and secured to the upstanding connection post 38. As will be readily appreciated from a study of FIG. 2, rotation of reel 22 in a clockwise direction serves to tighten and compress spring 78, such that a biasing force is successively built up serving to urge reel 22 in a counterclockwise rotational direction.

A length of flexible delivery conduit 82 also forms a part of delivery assembly 16. The innermost end of conduit 82 extends into the central portion of reel 22 through the access opening defined by edge 30, and is coupled by means of nut 84 to the end of elbow 76 remote from the sleeve 32. In the rest or retracted position of delivery assembly 16, the conduit 82 is helically wrapped about the sidewall 24, and presents a plurality of adjacent convolutions along the vertical length thereof. In this regard, the provision of helical guide wall 28 facilitates proper positioning of conduit 82 during the retraction procedure to be described. The outermost end of conduit 82 is provided with a delivery head (not shown) which can be inserted in a holder 86 (FIG. 1) when the apparatus 10 is not in use.

Referring now to FIGS. 2 and 3, a stationary, elongated extension guide 88 is disposed in spaced relationship to reel 22 for the purpose of guiding the extension of conduit 82 during use thereof. The guide 88 is located adjacent opening 52 so as to facilitate extension of conduit 82 and prevent conduit hangups, as will be readily seen.

Figure 7:
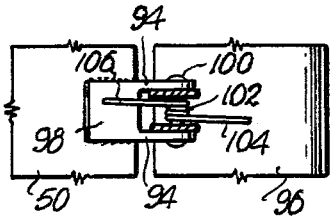
FIG. 7 is a fragmentary side elevational view taken along line 7—7 of FIG. 2.

Delivery assembly 16 also includes shiftable, one-way brake mechanism 90 mounted within opening 52 adjacent wall 50. Mechanism 90 includes an arcuate brake shoe or element 92 adjacent sidewall 24 and of complementary configuration relative to the latter. Element 92 is pivotally secured to a pair of vertically spaced arms 94 which extend from the element and are fixedly secured to a brake release flap 96. The arms 94 are secured to element 92 adjacent the righthand end thereof as viewed in FIG. 2, and these arms lie along an axis which is offset from the center and radius of reel 22. Flap 96 is in turn pivotally connected to wall 50 by means of a bifurcated connection bracket 98 and a pivot pin 100 (see FIG. 7). A coil-biasing spring 102 having endmost arms 104 and 106 is located about pin 100. The arms 104 and 106 serve to bias flap 96, and thereby arms 94 and element 92, into the rest position thereof illustrated in FIG. 2. Bracket 98 is secured to end wall 50 by means of screws 108; and to permit adjustment of bracket 98 in a horizontal direction, end wall 50 is slotted as at 110.

In the rest position of brake mechanism 90, essentially free rotation of reel 22 is permitted in the clockwise direction. Thus, the conduit 82 can be extended at will with no interference from the brake mechanism 90. However, when reel 22 begins or attempts to rotate in the counterclockwise direction under the influence of spring 78 (i.e., when the pulling force on conduit 82 is terminated), element 92 is pressed into engagement with reel 22 to immediately prevent significant counterclockwise rotation thereof. When it is desired to release the mechanism 90 from the rotation-blocking position, it is only necessary to depress flap 96, which in turn shifts element 92 away from the reel 22 to thus permit free retractive counterclockwise rotation.

In the use of apparatus 10 at a selected site, it is only necessary to grasp conduit 82 adjacent the outer delivery end thereof, and pull the conduit through the opening 52. This action is facilitated by virtue of the guide 88, which ensures that the conduit is smoothly extended without hangups. During the extension of conduit 82, reel 22 rotates in the clockwise direction as illustrated in FIG. 2 by virtue of the operative connection between the reel and conduit 82 at edge 30. The rotation of reel 22 also causes an increasing tension to be built up within coil spring 78, which thereby serves to bias the reel in a counterclockwise rotational direction. As explained, during extension of the conduit 82, brake element 92 is in the rest position thereof and permits essentially free rotation of the reel 22.

When conduit 82 has been extended to a desired use position, the pulling force exerted thereon by the user is terminated or greatly lessened. This causes a commencement of counterclockwise rotation of the reel as viewed in FIG. 2, under the influence of spring 78. However, significant counterclockwise rotation is prevented by virtue of the mechanism 92 which presses the element 92 into a rotation-blocking position. This occurs because of the length of the arms 94, and the geometrical relationship between the latter and the center and radius of reel 22. Specifically, when counterclockwise rotation of reel 22 is commenced, the arms 94 cannot be shifted linearly (because of the fixed connection to wall 50), and hence these arms cannot go "over center" relative to the geometrical center of reel 22. Thus, the element 92 is pressed into braking engagement with the wall 24. Conduit 82 is thereby effectively locked in the desired extended position, in order to permit easy use thereof.

At this point pump 18 is actuated in order to pump the liquid within tank 14 through conduit means 20, passage 64, elbow 76, and conduit 82. When the filling operation is completed, pump 18 is shut down.

The final step involves the retraction of conduit 82 to its original position in helically wrapped relationship about reel 22. This is accomplished by depression of the release flap 96 which pivots relative to the pin 100 and against the bias of spring 102. This pivoting causes brake element 92 to be shifted away from wall 24 so as to permit counterclockwise rotation of reel 22 and consequent retraction of the conduit 82. Depression of flap 96 can be accomplished manually or by pulling conduit 82 against the inturned terminal portion of the flap, as will be readily seen. In any event, counterclockwise rotation of reel 24 causes conduit 82 to be retracted and wound about the reel. Proper helical rewinding of the conduit 82 is assured by virtue of the guide wall 28 and stationary guide 88 which serve to rewind the conduit 82 in a helical fashion about and along the length of the wall 24 without hangups. The dispensing head connected to the outermost end of the conduit 82 is then inserted within the holder 86, in order to complete the rewinding operation.

What I claim is:

1. Liquid-dispensing apparatus, comprising: a tank adapted to hold a liquid to be dispensed; a liquid delivery assembly, including a rotatable reel;

a length of flexible liquid delivery conduit having an inner liquid-receiving end and an outer liquid-delivery end, said conduit having a retracted position wherein the conduit is wrapped about said reel, there being means operatively coupling said reel and conduit for rotation of the reel in a first direction when the conduit is grasped adjacent said delivery end thereof and pulled from the reel in order to extend the conduit for use thereof;

means for biasing said reel in a second rotational direction opposite to said first direction, when said conduit is extended;

brake mechanism including a brake element adjacent said reel and located in a rest position thereof lightly engaging a peripheral surface of the reel for permitting movement of said reel in said first direction during extension of said conduit to a desired use position, said mechanism serving in response to rotation of said reel in said second direction, to press said element against said reel in order to prevent further significant rotation of said reel in said second direction;

selectively operable release structure coupled to said brake mechanism for movement of said element from said reel-pressing position and permitting rotation of said reel in said second direction, said means coupling said reel and conduit serving to retract said conduit and rewrap the latter about said reel;

means for coupling said tank and said delivery end of said conduit for flow of said liquid through the latter; and means for selectively pumping said liquid from said tank and through said conduit for delivery thereof, said mechanism including an arm swingable relative to said reel about an axis substantially parallel to the axis of rotation of said reel, said element being attached to an inner end of said arm and said release structure including a rigid actuating member fixedly attached to an outer end of said arm in normally spaced proximity to said conduit, said arm and said element having a dimension measured radially from said swinging axis of the arm that exceeds the radial distance from said axis of the arm to said surface of the reel, and said arm and said element being disposed with said dimension thereof located behind a center line intersecting said axes with respect to said second direction of rotation of the reel.

said surface tending to swing said element away from the same during said extension of the conduit and rotation of the reel in said first direction and tending to swing the element into progressively tighter engagement with said surface in response to attempted rotation of the reel in said second direction, said conduit being selectively shiftable laterally of its longitudinal axis into actuating engagement with said member when the conduit is in an extended, use position for swinging the member, the arm and said element in a direction to swing said element away from said surface, thereby rendering said biasing means operable to rotate said reel in said second direction and retract said conduit.

2. The liquid-dispensing apparatus as set forth in claim 1 wherein said reel is rotatable about an upright axis.

3. The liquid-dispensing apparatus as set forth in claim 1 wherein said coupling means includes a stationary member having an upright, tubular, stationary, liquid-conveying section and means connecting the lower end of said section and the liquid-receiving end of said conduit, said reel being of tubular configuration and rotatable about the axis defined by said section.

4. The liquid-dispensing apparatus as set forth in claim 3 wherein said biasing means comprises a coil spring located within said reel and operatively coupled between said stationary member and the reel.

5. The liquid-dispensing apparatus as set forth in claim 1 wherein said tank and delivery assembly are located within a common housing.

6. The liquid-dispensing apparatus as set forth in claim 1 wherein said reel has a substantially tubular sidewall, and said conduit is wrapped about said sidewall in successive convolutions in the retracted position of the conduit.

7. The liquid-dispensing apparatus as set forth in claim 6 including a guide structure on said reel for helically wrapping said conduit about and along the length of said reel.

8. The liquid-dispensing apparatus as set forth in claim 1 wherein said release structure further includes means yieldably urging said element against said surface of the reel.

* * * * *